United States Patent [19]

Tanaka et al.

[11] Patent Number: 5,077,584

[45] Date of Patent: Dec. 31, 1991

[54] TONER SUPPLY DEVICE FOR ELECTROPHOTOGRAPHIC EQUIPMENT

[75] Inventors: Masaru Tanaka; Seiji Oka, both of Yokohama, Japan

[73] Assignee: Ricoh Company, Ltd., Tokyo, Japan

[21] Appl. No.: 509,158

[22] Filed: Apr. 16, 1990

[30] Foreign Application Priority Data

Apr. 19, 1989 [JP] Japan ..... 1-99750

[51] Int. Cl.[5] ..... G03G 15/06

[52] U.S. Cl. ..... 355/260; 118/653; 222/DIG. 1; 355/245

[58] Field of Search ..... 222/DIG. 1; 355/246, 355/260, 245, 251, 253, 653, 657, 658; 118/644, 688, 689, 690, 691

[56] References Cited

U.S. PATENT DOCUMENTS

| | | | |
|---|---|---|---|
| 4,601,259 | 7/1986 | Yamashita | 118/658 |
| 4,629,309 | 12/1986 | Tsukano et al. | 222/DIG. 1 X |
| 4,734,738 | 3/1988 | Koichi | 355/246 X |
| 4,742,370 | 5/1988 | Murakami et al. | 355/246 |
| 4,782,360 | 11/1988 | Iwamoto et al. | 355/326 |
| 4,821,075 | 4/1989 | Saito et al. | 355/260 X |
| 4,878,091 | 10/1989 | Morita et al. | 355/260 |
| 4,912,512 | 3/1990 | Midorikawa et al. | 355/260 |
| 4,919,071 | 4/1990 | Gatti | 222/DIG. 1 |
| 4,937,628 | 6/1990 | Cipolla et al. | 355/260 |

*Primary Examiner*—A. T. Grimley
*Assistant Examiner*—Thu Anh Dang
*Attorney, Agent, or Firm*—Oblon, Spivak, McClelland, Maier & Neustadt

[57] ABSTRACT

A toner supply device incorporated in electrophotographic equipment which develops a latent image electrostatically formed on an image carrier by using toner. The device has a toner tank for supplying toner to a developing section which forms a part of the equipment, a toner sensor responsive to the amount of toner remaining in the toner tank, and a toner server adjoining the toner tank for feeding toner to the tank. The toner server has a plurality of toner cartridges thereinside and automatically replaces the toner cartridge a plurality of times.

3 Claims, 5 Drawing Sheets

TONER SUPPLY DEVICE FOR ELECTROPHOTOGRAPHIC EQUIPMENT

BACKGROUND OF THE INVENTION

The present invention relates to a toner supply device for electrophotographic equipment which develops a latent image electrostatically formed on an image carrier by using toner.

An electrophotographic copier, facsimile machine, printer or similar equipment using an electrophotographic process is extensively used. This kind of equipment forms a latent image on an image carrier and then develops it by a developer which is generally implemented by toner. The toner is sequentially consumed in a developing section and, therefore, fed from a toner tank in an adequate manner. Toner has to be fed to the toner tank also, because the toner in the tank sequentially decreases with the lapse of time due to the consumption in the developing section. Various approaches have heretofore been proposed for the supply of toner from the toner tank to the developing section and to the supply of toner to the tank itself. One of them uses a toner tank having a size large enough to accommodate a great amount of toner. A problem with this scheme is that the great amount of toner stored in the toner tank is apt to solidify due to changes in temperature and humidity. Should the solidified toner accumulate in the tank, the amount of toner supply to the developing section would become irregular while the charging characteristic of the toner would be degraded. On the other hand, when the toner tank is reduced in size in order to reduce the amount of toner accommodatable therein and is operated in combination with a toner cartridge or a toner container which is a conventional implementation, the toner cartridge or the toner container has to be replaced frequently increasing the burden on the operator. Further, the toner cartridge cannot be increased in size beyond a certain limit when it comes to electrophotographic equipment of the type having an optical unit above the toner tank.

SUMMARY OF THE INVENTION

It is therefore an object of the present invention to provide a toner supply device for electrophotographic equipment which eliminates the irregular supply of toner and the degradation of the charging characteristic of toner which are ascribable to the solidification of toner.

It is another object of the present invention to provide a toner supply device for electrophotographic equipment which reduces the frequency of replacement of a toner cartridge and, thereby, frees the operator from an excessive burden.

It is another object of the present invention to provide a generally improved toner supply device for electrophotographic equipment.

A toner supply device for supplying toner to a developing section of electrophotographic equipment of the present invention comprises a toner tank for storing toner to be supplied to the developing section, a remaining toner sensor for sensing an amount of toner remaining in the toner tank, and a toner server adjoining the toner tank for supplying toner to the toner tank.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to some prior art toner supply devices.

Figure 1:
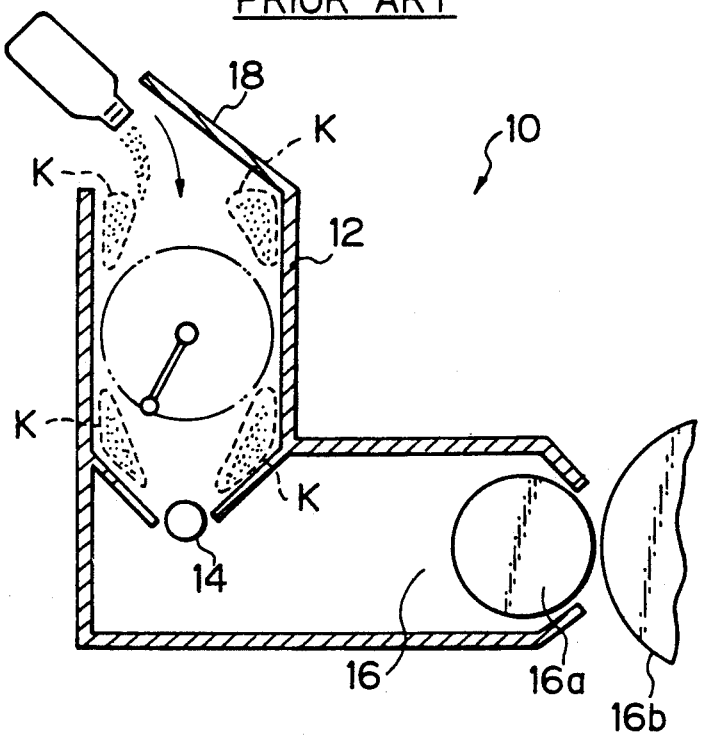
Fig. 1 PRIOR ART
FIGS. 1 to 4 are sections each showing a different prior art toner supply device for electrophotographic equipment.
Figure 2:
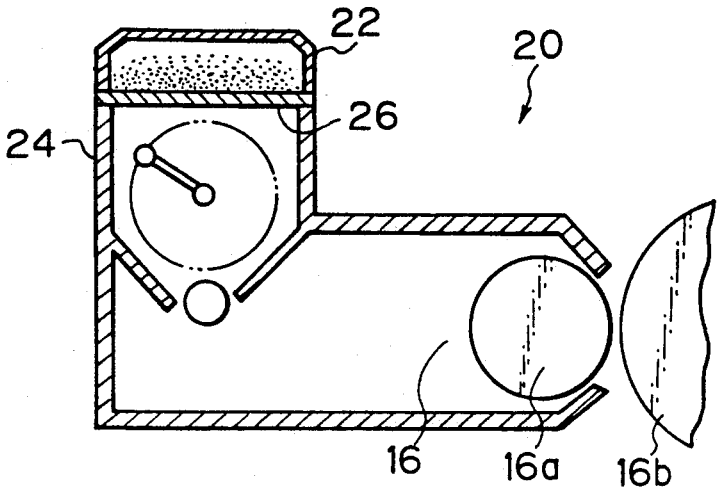
Fig. 2 PRIOR ART
Figure 3:
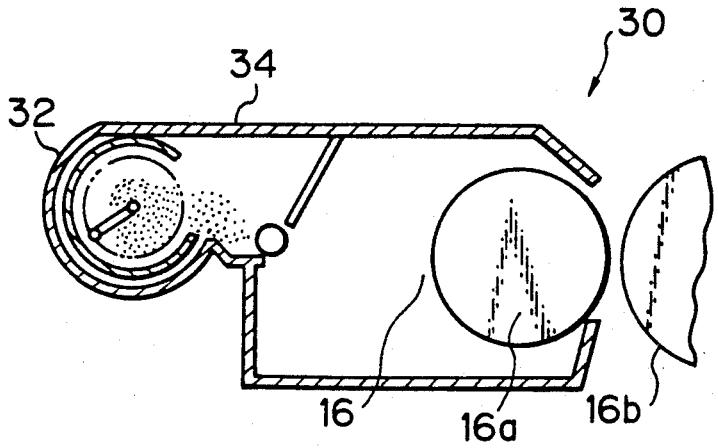
Fig. 3 PRIOR ART
Figure 4:
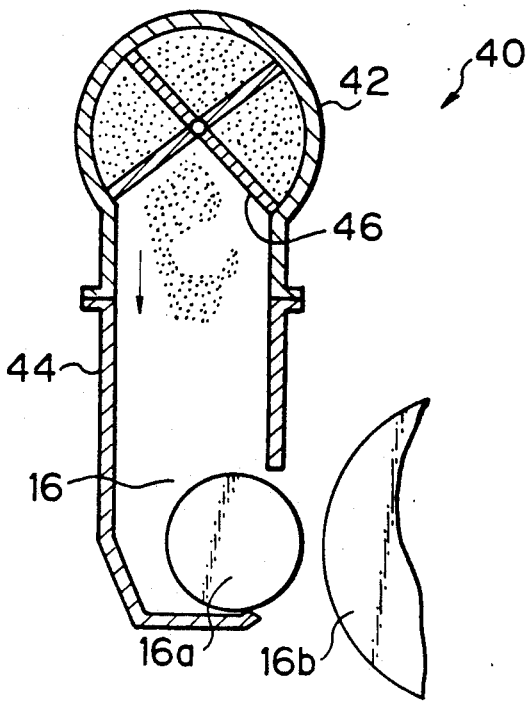
Fig. 4 PRIOR ART

Referring to FIG. 1 of the drawings, a prior art toner supply device, generally 10, has a toner tank 12 capable of accommodating a relatively great amount of toner such as 1 kilogram to 2 kilograms of toner. The toner is fed out by a supply roller 14 from the toner tank 12 to a developing section 16 where a developing roller **16*a* and a photoconductive element 16*b* are located face-to-face. When the amount of toner remaining in the toner tank 12 decreases, a cover 18 is opened to supply toner into the toner tank 12. FIG. 2 shows another prior art toner supply device 20. This prior art device 20 has a toner tank 24 and is operable with a toner cartridge 22 which is removably mounted on the tank 24. The toner cartridge 22 is provided with a shutter 26. The shutter 26 is openable to supply toner into the toner tank 24. When the remaining amount of toner in the toner tank decreases, the toner cartridge 22 is replaced with a new toner cartridge so that further toner may be supplied to the tank 24. Still another prior art toner supply device is shown in FIG. 3. In FIG. 3, the toner supply device, generally 30, has a toner tank 34 in which a toner container 32 is removably received. When the toner tank 34 is short of toner, the toner container 32 is replaced with a new one in the same manner as the toner cartridge 22. FIG. 4 indicates a toner supply device which is disclosed in Japanese Utility Model Laid-Open Publication (Kokai) No. 55-26528. The toner supply device, generally 40, disclosed in this Laid-Open Publication has a toner tank 44 and uses a toner cartridge 42 which is removably mounted on the tank 44. A rotatable partition member 46 is disposed in the toner cartridge 42 to define a plurality of compartments thereinside. Toner filling the individual compartments is hermetically sealed by the partition member 46. As the amount of toner remaining in the toner tank 44 decreases, the partition member 46 is suitably rotated to supply the toner into the toner tank 42**.

A problem with the toner supply device 10 is that since the toner tank 12 is loaded with a great amount of toner, the toner is apt to solidify due to temperature and humidity. It is likely, therefore, that the solidified toner sequentially accumulates on the walls of the toner tank 12, especially in an area K shown in FIG. 1. This prevents the toner from being fed in a constant amount to the developing section 16, while degrading the charging characteristic of the toner.

The approaches shown in FIGS. 2 and 3 are successful in preventing the toner from solidifying because the amount of toner stored is usually not more than 600 grams to 1 kilogram. Such an approach, however, brings about another drawback that the toner cartridge 22 or the toner container 32 has to be replaced quite often, increasing the burden on the operator. Specifically, since the operator has to replace the toner cartridge 22 or the toner container 32, the toner is apt to smear the operator's hands or to be prevented from being accurately supplied due to the manual operation.

Figure 5:
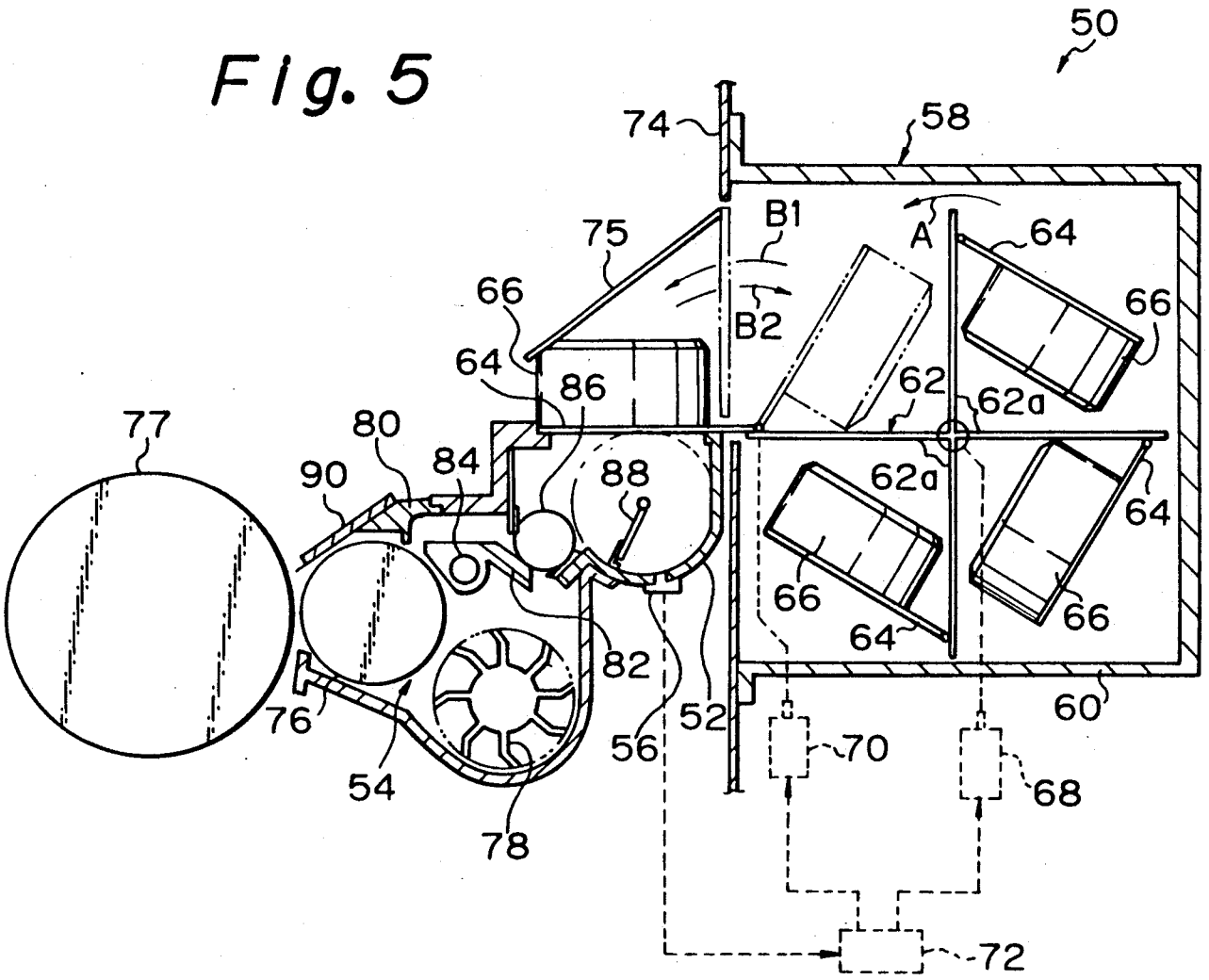
FIG. 5 is a section showing a toner supply device embodying the present invention.

The toner supply device 40 shown in FIG. 5 also succeeds in preventing the toner from solidifying due to the partition member 46. However, this kind of scheme is problematic when it comes to electrophotographic equipment of the type having an optical unit above the toner tank 44. Specifically, since the toner cartridge 42 is located above the toner tank 44, the size of the toner cartridge 42 available with the above-mentioned type of equipment is limited and, hence, the cartridge 42 cannot be loaded with a great amount of toner.

Referring to FIGS. 5 to 8, a toner supply device embodying the present invention is shown which is applied to a copier by way of example. As shown, the toner supply device, generally 50, has a toner tank 52 for feeding toner to a developing section 54. A toner sensor 56 produces a toner end signal when the amount of toner remaining in the toner tank 52 becomes smaller than a predetermined amount. In this sense, the toner end sensor 56 plays the role of remaining toner sensing means. A toner server 58 adjoins the toner tank 52 and supplies toner into the toner tank 52. The toner server 58 has a body 60, a rotatable member 62, a plurality of cartridge supports 64, a plurality of toner cartridges 66, a first drive motor 68, a second drive motor 70, and a control unit 72. The server body 60 is mounted on a side panel 74 of the copier body and accommodates the rotatable member 62, cartridge supports 64, and toner cartridges 66 therein. The rotatable member 62 is journalled to the server body 60 and has a plurality of radially extending extensions **62*a*. Arranged at substantially equal intervals in the circumferential direction, the extensions 62*a* each retains one of the cartridge supports 64 rotatably at its outermost end. Each toner cartridge 66 is filled with toner and removably mounted on one of the cartridge support 64. The toner server 58 is, therefore, loaded with a great amount of toner such as 2 kilograms of toner in masses in its toner caridges 66. When any one of the toner cartridges 66 runs out of toner, the operator will remove it from the cartridge support 64** and mount a new toner cartridge instead.

The first motor 68 drives the rotatable member 62 in a direction indicated by an arrow A in FIG. 5, while the second motor 70 selectively rotates the individual cartridge supports 64 in opposite directions as indicated by arrows $B_1$ and $B_2$ in FIG. 5. The control unit 72 is implemented as a microcomputer and interconnected to the toner sensor 56 and motors 68 and 70. The control unit 72 has a built-in ROM which stores a program therein. This program will be described later with reference to FIG. 8. By executing the program, the control unit 72 drives the motors 68 and 70 in response to the output of the toner sensor 56 and others. The control unit 72, therefore, serves as control means for controlling the motors 68 and 70 in response to the output of the remaining toner sensing means.

Figure 6:
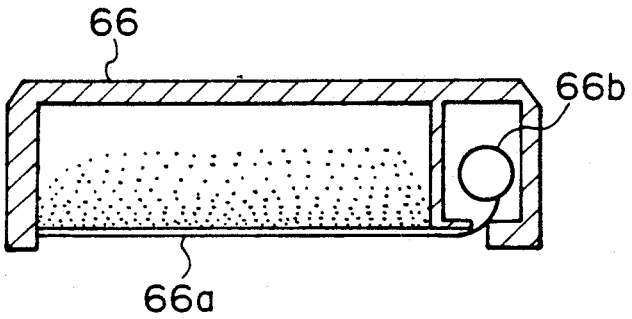
FIG. 6 is a sectional front view of a toner cartridge included in the illustrative embodiment.
Figure 7:
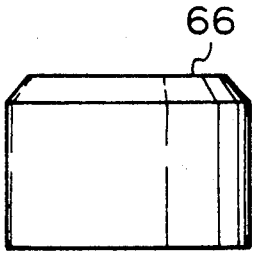
FIG. 7 is a side elevation of the toner cartridge.

Assume that the rotatable member 62 is moved to and stopped at the position shown in FIG. 5, and then the top left cartridge support 64 as viewed in the figure is brought to a position indicated by a solid line in the figure. Then, the top left toner cartridge 66 is positioned immediately above the toner tank 52 to supply toner into the latter. Specifically, as shown in FIGS. 6 and 7, each toner cartridge 66 is hermetically sealed by a seal **66*a*. When the toner cartridge 66 is brought to the position immediately above the toner tank 52, a roller 66*b* rolls up the seal 66*a* with the result that the toner is let fall into the toner tank 52. The control unit 72 is interconnected to the roller 66*b*** to control the operation of the latter.

In FIG. 5, a flap or door 75 opens and closes as the top left cartridge support 64 as viewed in FIG. 5 is rotated. A drum 77 plays the role of an image carrier for carrying an electrostatic latent image thereon, while a developing sleeve 76 serves as a developer carrier for developing the latent image. A paddle wheel 78 drives a developer which is either toner or a toner and carrier mixture to the developing sleeve 76. A doctor blade 80 regulates the thickness of a developer layer formed on the developing sleeve 76. While the doctor blade 80 removes an excessive part of the developer from the sleeve 76, a separator 82 having fins thereon agitates the removed developer in the direction perpendicular to the sheet surface of FIG. 5. A screw 84 draws in a part of the developer existing on the separator 82 and agitates it in the same direction as the separator 82 while maintaining its balance with the fins of the separator 82. A supply roller 86 feeds a supplementary amount of toner from the toner tank 52. An agitator 88 drives the toner toward the supply roller 86. An inlet seal is provided above the developing roller 76 to prevent the toner from scattering to the outside from the developing roller 76.

Figure 8:
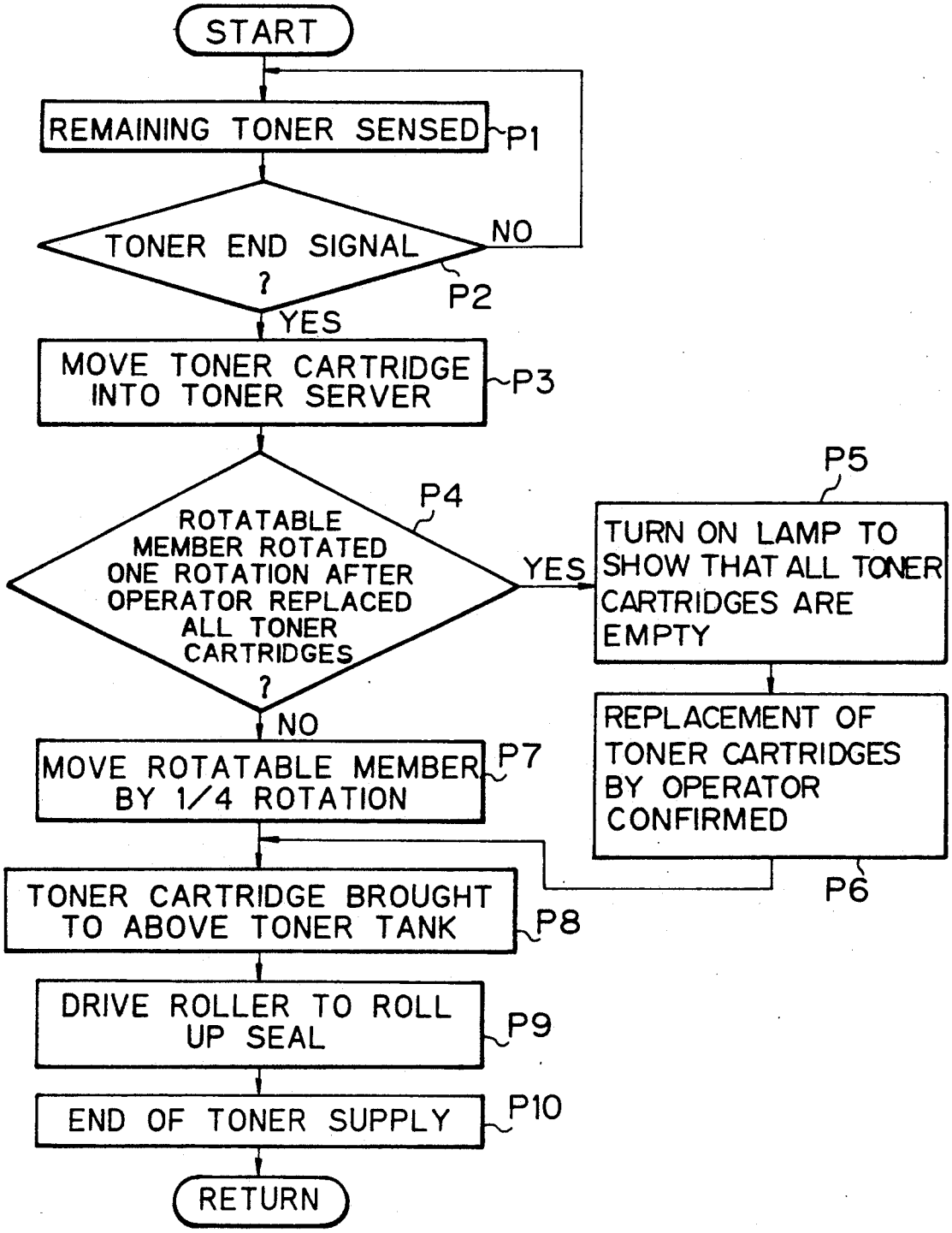
FIG. 8 is a flowchart demonstrating a sequence of steps for supplying toner to a toner tank particular to the illustrative embodiment.

Referring to FIG. 8, the control program begins with a step $P_1$ in which the toner sensor 56 senses the amount of toner remaining in the toner tank 52. Then, whether or not the toner sensor 56 has outputted a toner end signal is determined (step $P_2$). If the answer of the step $P_2$ is NO, the program returns to the step $P_1$. If the answer of the step $P_2$ is YES, a step $P_3$ is executed to feed a drive signal to the second drive motor 70. In response, the motor 70 angularly moves the top left cartridge support 64, FIG. 5, from the solid line position to the phantom line position in the direction $B_2$. As soon as this cartridge support 64 and, therefore, its empty toner cartridge 66 is fully received in the server body 60, the program executes a step $P_4$. In the step $P_4$, whether or not the rotatable member 62 has rotated one full rotation after the operator had replaced all the toner cartridges 66 with new ones is determined. If the answer of the step $P_4$ is YES, a lamp or similar displaying means is energized to alert the operator to the fact that all the cartridges 66 are empty (step $P_6$). When the program determines that the operator has replaced all the cartridges 66 in the toner server 58 with new ones (step $P_6$), the program advances to a step $P_8$. If the answer of the step $S_4$ is NO, a control signal is fed to the first motor 68 to drive the rotatable member 62 by one-fourth of a rotation (step $P_7$), also followed by the step $P_8$. In the step $P_8$, a drive signal is delivered to the second motor 70 to angularly move the cartridge support 64 from the phantom line position to the solid line position in the direction $B_1$, whereby the toner cartridge 66 mounted on the cartridge support 64 is brought to the position immediately above the toner tank 52. In this condition, a drive signal is fed to the roller **66*b* to roll up the seal 66*a* (step $P_9$). As a result, the toner is let fall from the toner cartridge 66 into the toner tank 52** (step $P_{10}$).

As stated above, in the illustrative embodiment, the great amount of toner is stored in the server body 60 in masses each being received in respective one of the plurality of toner cartridges 66 and is hermetically confined by the seals 66*a*. The toner is, therefore, prevented from solidifying despite changes in temperature and humidity. This insures the supply of a constant amount of toner all the time and frees the toner from the degradation of charging characteristic. The four toner cartridges 66 can be replaced at a time, i.e., without resorting to four consecutive times of replacement, reducing the load on the operator. Further, it is not necessary for the operator to remove the seals 66*a* by hand, so that the operator is free from smears while inaccurate toner supply due to manual operations is eliminated.

In summary, in accordance with the present invention, a toner server has a plurality of toner cartridges and automatically replaces the toner cartridge a plurality of times. The toner server, therefore, is capable of storing a great amount of toner in small masses to eliminate the solidification of the toner which would result in the irregular toner supply and the degradation of charging characteristic of toner.

Further, a plurality of times of toner cartridge replacement heretofore needed are completed at a time. This reduces the frequency of replacement of the toner cartridge and, therefore, the burden on the operator.

Various modifications will become possible for those skilled in the art after receiving the teachings of the present disclosure without departing from the scope thereof.

What is claimed is:

1. A toner supply device for supplying toner to a developing section of electrophotographic equipment, comprising:

a toner tank for storing toner to be supplied to the developing section;

remaining toner sensing means for sensing an amount of toner remaining in said toner tank; and a toner server adjoining said toner tank for supplying toner to said toner tank, wherein said toner server comprises a body, a rotatable member rotatably supported by said body and comprising a plurality of radially extending extensions which are arranged in a circumferential direction, a plurality of cartridge supports each being rotatably mounted on a respective one of said extensions, a plurality of toner cartridges each being removably mounted on a respective one of said cartridge supports and storing toner therein, drive means for driving said rotatable member and said cartridge supports, and control means for controlling said drive means in response to an output of said remaining toner sensing means.

2. A toner supply device for supplying toner to a developing section of electrophotographic equipment, comprising:

a toner tank for storing toner to be supplied to the developing section;

remaining toner sensing means for sensing an amount of toner remaining in said toner tank;

a toner server adjoining said toner tank for supplying toner to said toner tank; wherein said toner server comprises a body, a rotatable member rotatably supported by said body and comprising a plurality of radially extending extensions which are arranged at substantially equal intervals in a circumferential direction, a plurality of cartridge supports each being rotatably mounted on an outermost end portion of respective one of said extensions, a plurality of toner cartridges each being removably mounted on respective one of said cartridge supports and storing toner therein, a first drive motor for rotating said rotatable member, a second drive motor for rotating said cartridge supports one at a time, and control means for controlling said first and second motors in response to an output of said remaining toner sensing means.

3. A device as claimed in claim 2, wherein said control means controls said first and second motors such that when said rotatable member and said cartridge support members are rotated to a predetermined position, one of said toner cartridges is positioned immediately above said toner tank to supply the toner into said toner tank.

* * * * *